US005521056A

United States Patent [19]

Buchanan et al.

[11] Patent Number: 5,521,056

[45] Date of Patent: May 28, 1996

[54] PHOTOGRAPHIC PERACID BLEACHING COMPOSITION AND PROCESSING METHOD USING TERNARY IRON CARBOXYLATE COMPLEXES AS CATALYSTS IN PERACID BLEACHING SOLUTIONS

[75] Inventors: John M. Buchanan, Rochester; Eric R. Brown, Webster; Stuart T. Gordon, Pittsford, all of N.Y.

[73] Assignee: Eastman Kodak Company, Rochester, N.Y.

[21] Appl. No.: 370,743

[22] Filed: Jan. 10, 1995

[51] Int. Cl.[6] ..... G03C 7/42

[52] U.S. Cl. ..... 430/430; 430/393; 430/461; 430/943

[58] Field of Search ..... 430/393, 430, 430/461, 943

[56] References Cited

FOREIGN PATENT DOCUMENTS

| | | |
|---|---|---|
| 0329088A3 | 8/1989 | European Pat. Off. . |
| 3939755 | 12/1989 | European Pat. Off. . |
| 0534086A1 | 3/1993 | European Pat. Off. . |
| 0567126A1 | 10/1993 | European Pat. Off. . |
| 50-26542 | 3/1975 | Japan . |
| 53-048527 | 5/1978 | Japan . |

*Primary Examiner*—Hoa Van Le

*Attorney, Agent, or Firm*—J. Lanny Tucker

[57] ABSTRACT

A photographic peracid bleaching composition contains a peracid bleaching agent, and a water-soluble ternary complex of ferric ion, a polycarboxylate ligand, and a second ligand which has at least one carboxyl group on an aromatic nitrogen heterocycle, such as a pyridinecarboxylic acid. These complexes act as catalysts for the peracid bleaching agent. Preferred complexes are biodegradable, but all of the ternary complexes can be used in a variety of peracid bleaching processes to good advantage.

21 Claims, 2 Drawing Sheets

PHOTOGRAPHIC PERACID BLEACHING COMPOSITION AND PROCESSING METHOD USING TERNARY IRON CARBOXYLATE COMPLEXES AS CATALYSTS IN PERACID BLEACHING SOLUTIONS

FIELD OF THE INVENTION

The present invention relates to a photographic peracid bleaching composition, and to a method for its use to process imagewise exposed and developed color photographic elements.

BACKGROUND OF THE INVENTION

Common bleaching agents generally fall into two broad classes: (1) iron-based bleaching agents, and (2) peracid bleaching agents. Examples of the first class include ferricyanide, ferric complexes of ethylenediaminetetraacetic acid (EDTA) and 1,3-propylenediaminetetraacetic acid (PDTA), and the ferric complex of beta-alaninediacetic acid (ADA). Ferricyanide has excellent silver bleaching capability, but once released into the environment, it can cause aquatic toxicity due to the photochemical liberation of free cyanide ion. Ferric PDTA is likewise a good silver bleaching agent, but PDTA is not readily biodegradable. Ferric ADA uses a biodegradable ligand, but its strength as a bleaching agent is inferior to that of FePDTA. Therefore, it must be used in higher concentrations which are undesirable for cost and environmental reasons. In general, iron-based bleaching agents also have the environmental disadvantage of contributing relatively high concentrations of iron to photographic effluent. A growing number of regulations, particularly in Europe, restrict the discharge of iron from photofinishing operations.

Examples of the second class of bleaching agents include three distinct subclasses: (a) hydrogen peroxide and peroxide precursors such as perborate and percarbonate, (b) persulfate acids and salts, and (c) perhalogen acids and salts, such as chlorate, bromate, iodate and perchlorate.

The perhalogen bleaching agents are not often used for silver halide color photographic systems because of their tendency to degrade dye images. Hydrogen peroxide bleaches generally have excellent environmental properties, but all peroxide bleaching compositions described to date suffer from one or more deficiencies (see for example, U.S. Pat. No. 4,277,556 of Koboshi et al, U.S. Pat. No. 4,301,236 of Idota et al and U.S. Pat. No. 4,717,649 of Hall et al). Such deficiencies include incomplete silver bleaching, incomplete retention of bleached silver in the element, vesiculation (formation of small bubbles and pinholes from release of oxygen) in the element, and inadequate stability of bleaching solutions during storage and use.

Persulfate bleaching agents, especially ammonium persulfate and sodium persulfate, are used in some commercial photographic process (such as the Eastman Color Print process for motion picture film), but these processes require a separate bleach accelerator bath, the active ingredient of which, is an alkyl thiol, which has a foul odor.

Metal-catalyzed persulfate bleaching solutions avoid the need for a thiol bath and generally require much lower metal concentrations than bleach solutions containing iron-based bleaching agents. However, such bleaching solutions have significant limitations. Research Disclosure publication 15704 (Vol 1.157, May 1977, page 8) teaches the use of a variety of metal complexes as catalysts for persulfate bleaching. With the exception of iron and perhaps manganese, the aquatic toxicity of the metal ions themselves precludes the practice use of such complexes as bleaching agents. The one ferric complex disclosed in this publication, iron complexed with 2,2'-bipyridine, requires a prohibitively expensive ligand and has a tendency to be retained in the photographic element, leaving an undesirable pinkish-red stain.

The bleaching agents described in DE 3,919,551 A1 slowly and incompletely bleach photographic elements with substantial contents of silver bromide and silver iodide. Another disadvantage of these bleaching solutions is that they exhibit the best bleaching performance at below pH 3 where persulfate undergoes acid-catalyzed decomposition. This results in poor stability of the bleaching solutions.

Useful iron-catalyzed bleaching solutions are described in copending and commonly assigned U.S. Ser. No. 08/230,189 (filed Apr. 20, 1994, by Buchanan et al). These bleaching compositions offer excellent silver bleaching and good stability, but further improvements are needed because the preferred ferric catalysts have low water solubility and sometime result in the formation of crystalline solids in bleaching and replenisher solutions.

Japanese Kokai 51-07930 (published Jan. 22, 1976) describes the use of nitrolotriacetic acid or 2,6-pyridinecarboxylic acid or both to reduce stain in ferric-based bleaching solutions. The publication teaches that stain reduction is achieved equally well when the ligands are included in the bleaching solution, in the bleaching solution and neutralizing bath, or in the fixing bath. This reference therefore teaches away from the criticality of these ligands or their iron complexes as silver bleaching agents. Moreover, there is no mention of peracid bleaching agents.

Japanese Kokai 53-048527 (published May 2, 1978) describes the use of bleaching solutions containing aminopolycarboxylic acid metal complexes and/or a polycarboxylic acid metal complex salt (such as a 2,6-pyridinedicarboxylic acid salt). The preferred metal complex is FeEDTA, and the alleged advantage is reduced fog and high color image density. There is no suggestion of silver bleaching advantages or the use of peracid bleaching agents.

Japanese Kokai 50-26542 (published Mar. 19, 1975) describes bleaching solutions containing an iron chelate with one or more ligands such as 2-carboxypyridine, 8-hydroxyquinoline or 2-carboxypyrazine. These solutions fail to provide the rapid and superior bleaching performance desired in the industry. Furthermore, this publication teaches the use of very high iron concentrations (for example, 0.554 mol/l in Example 1), and makes no mention of peracid bleaching agents. It therefore teaches away from the use of low concentrations of iron complexes to catalyze peracid bleaching agents.

Bleaching solutions have been developed which contain more than one ligand and which help provide rapid bleaching without unwanted dye formation in color photographic materials. However, such solutions contain two distinct iron-complex salts. For example, in KODAK FLEXICOLOR™ Bleach II, one salt is ferric ammonium-EDTA, and the other is ferric ammonium-PDTA. While such mixtures are stable and provide excellent bleaching, neither of the noted complexes is readily biodegradable. Other mixtures of complexes are described in EP-A-0 430 000, but they lack stability when used in combination with thiosulfate fixing agents. Other ligand mixtures are described in EP-A-0 534 086 wherein bidentate ligands are used as buffering agents.

Useful ternary bleaching agents are described in copending and commonly assigned U.S. Ser. No. 08/128,626 (filed Sep. 28, 1993, by Gordon et al). Such materials comprise one iron atom and two different ligands. While these materials are useful in some processes, there continues to be a need for more rapid processes using biodegradable materials. Moreover, they are restricted to use in bleach-fixing solutions.

There remains a need in the art for highly water-soluble catalysts for peracid bleaching solutions which catalysts preferably comprise biodegradable ligands, provide rapid bleaching and are compatible with chloride rehalogenation.

SUMMARY OF THE INVENTION

The problems noted above have been solved with a composition for bleaching an imagewise exposed and developed silver halide color photographic element comprising, a peracid bleaching agent, and as a catalyst for the bleaching agent, a ternary complex formed from:

a) an iron salt, b) a polycarboxylate or aminocarboxylate ligand, and c) a carboxylate ligand containing an aromatic nitrogen heterocycle, wherein the mol ratio of b) ligand to iron in the complex is at least 1:1, and the mol ratio of c) ligand to iron in the complex is at least 0.6:1, the composition having a pH of from about 3 to about 7 provided by an acidic compound other than any of a), b) and c).

The invention also provides a photographic bleaching method comprising processing an imagewise exposed and developed silver halide color photographic element with the bleaching composition described above.

The photographic processing composition of this invention provides strong and rapid bleaching by peracid bleaching agents. Moreover, the preferred catalysts for the peracid bleaching agents are highly water-soluble and biodegradable.

These advantages have been achieved using as catalysts certain ternary iron complexes formed from selected combinations of carboxylate ligands. A first ligand is a polycarboxylate or aminopolycarboxylate, and a second ligand is a carboxylate containing a nitrogen heterocycle. Moreover, the mol ratios of the specific ligands to the iron are critical for achieving superior catalysis, and for avoiding rust formation and water-insolubility. Thus, the mol ratio of the first ligand to iron is at least 1:1, and the mol ratio of the second ligand to iron is at least 0.6:1.

It is apparent from the experimentation done with the present invention that one skilled in the art cannot reasonably predict the formation of ternary complexes merely by mixing various known ligands with iron salts. In many cases, a mixture of binary complexes is formed, which is not the present invention. With the materials described herein, however, true ternary complexes were formed.

DETAILED DESCRIPTION OF THE INVENTION

Figure 1:
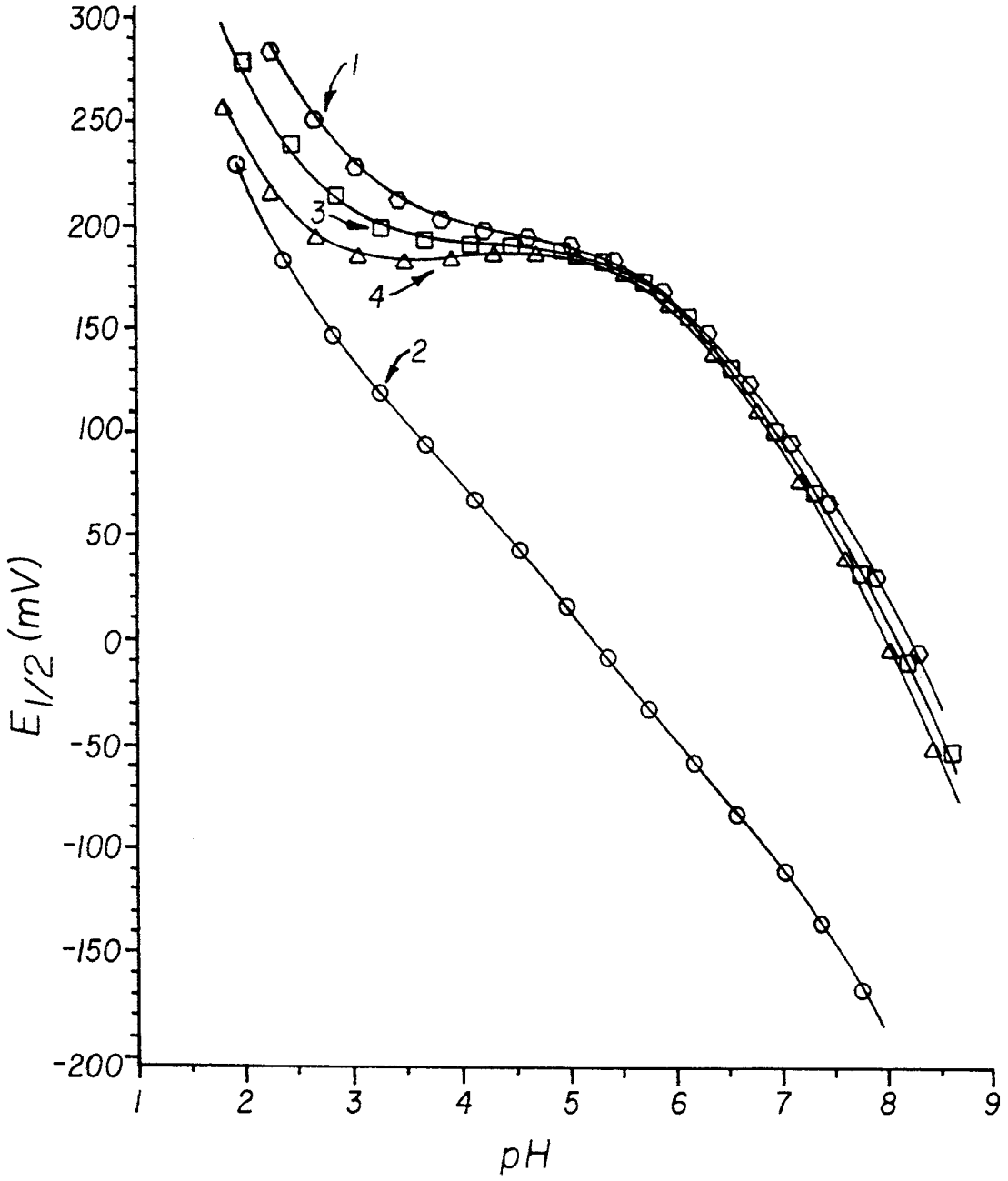
FIGS. 1 and 2 are graphical plots of redox potential vs. pH for various ternary and binary complexes as described in Example 1 below.

The bleaching composition of this invention includes one or more ternary iron complexes, each complex being composed of iron and one or more ligands from each of two distinctly different classes of ligands which are defined below. Thus, the ternary complex used in this invention is the complex formed from an iron salt with two distinctly different ligand structures.

The formation of a ternary complex from a metal ion and two different chelating compounds can be measured by direct pH titration methods as described, for example, by Irving et al in *J. Chem. Soc.*, 2904 (1954). Alternatively, spectral methods can be used if the complexes have sufficiently different absorption spectra from the individual ligands or the uncomplexed metal ion salt.

Potentiometric measurements of the type described by Bond et al in *J. Faraday Soc.*, 55, 1310 (1959) can also be used to study ternary complexation. Potentials are measured in a solution containing equal concentrations of ferric-ion salt and ferrous-ion salt to which are added different amounts of each of the two chelating ligands of interest. This method is demonstrated in Example 1 below.

The iron salts used as bleaching agents in the practice of this invention are generally ferric ion salts which provide a suitable amount of ferric ion for complexation with the ligands defined below. Useful ferric salts include, but are not limited to, ferric nitrate nonahydrate, ferric ammonium sulfate, ferric oxide, ferric sulfate and ferric chloride. Ferric nitrate nonahydrate is preferred. These salts can be provided in any suitable form and are available from a number of commercial sources.

Alternatively, ferric salts can be generated from the corresponding ferrous ion salts, such as ferrous sulfate, ferrous oxide, ferrous ammonium sulfate and ferrous chloride. Generating the desired ferric ions requires an additional step of oxidation of the ferrous ion by a suitable means, such as by bubbling air or oxygen through a ferrous ion solution.

The first class of ligands used in this invention are polycarboxylate or aminocarboxylate ligands which are well known in the art and include compounds having at least two carboxyl groups (polydentate), or their corresponding salts. Such ligands can be bidendate, tridentate, tetradentate, pentadentate and hexadentate ligands, referring to the number of sites available to bind to ferric ion. These ligands must be water-soluble also, and are preferably biodegradable (defined below). These ligands are identified as "b) ligands" hereinafter.

More specifically, b) ligands include, but are not limited to, hydroxycarboxylic acids, alkylenediaminetetracarboxylic acids having a tertiary nitrogen atom, alkylenediaminepolycarboxylic acids having a secondary nitrogen atom, iminopolyacetic acids, substituted ethyliminopolycarboxylic acids, aminopolycarboxylic acids having an aliphatic dibasic acid group and amino ligands having an aromatic or heterocyclic substituent.

Representative useful classes of b) ligands are defined below in reference to structures (I)–(VII), although it should be recognized that the invention is not limited in practice to these ligands.

Thus, useful b) ligands can be compounds having any of the following structures:

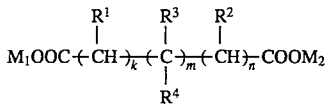

(I)

wherein $R^1$ and $R^2$ are independently hydrogen or hydroxy, $R^3$ and $R^4$ are independently hydrogen, hydroxy or carboxy (or a corresponding salt), $M_1$ and $M_2$ are independently hydrogen or a monovalent cation (such as ammonium, sodium, potassium or lithium), k, m and n are 0 or 1, provided that at least one of k, m and n is 1, and further provided that compound (I) has at least one hydroxy group,

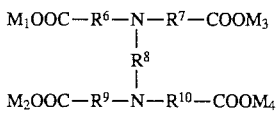

(II)

wherein $R^6$, $R^7$, $R^8$, $R^9$ and $R^{10}$ are independently a linear or branched substituted or unsubstituted alkylene group of 1 to 8 carbon atoms (such as methylene, ethylene, trimethylene, hexamethylene, 2-methyltrimethylene and 4-ethylhexamethylene), and $M_1$, $M_2$, $M_3$ and $M_4$ are independently hydrogen or a monovalent cation, as defined above for $M_1$ and $M_2$,

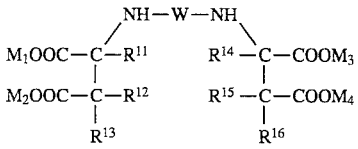

(III)

wherein $R^{11}$, $R^{12}$, $R^{13}$, $R^{14}$, $R^{15}$ and $R^{16}$ are independently hydrogen, hydroxy, a linear or branched substituted or unsubstituted alkyl group of 1 to 5 carbon atoms (such as methyl, ethyl, propyl, isopropyl, n-pentyl, t-butyl and 2-ethylpropyl), a substituted or unsubstituted cycloalkyl group of 5 to 10 carbon atoms in the ring (such as cyclopentyl, cyclohexyl, cycloheptyl and 2,6-dimethylcyclohexyl), or a substituted or unsubstituted aryl group having 6 to 10 carbon atoms in the aromatic nucleus (such as phenyl, naphthyl, tolyl and xylyl), $M_1$, $M_2$, $M_3$ and $M_4$ are as defined above, and W is a covalent bond or a divalent substituted or unsubstituted aliphatic linking group (defined below),

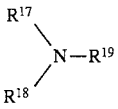

(IV)

wherein at least two of $R^{17}$, $R^{18}$ and $R^{19}$ are a carboxymethyl (or equivalent salts), and the third group is hydrogen, a substituted or unsubstituted alkyl group of 1 to 5 carbon atoms (as defined above), a substituted or unsubstituted hydroxyethyl or unsubstituted carboxymethyl (or equivalent salts),

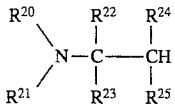

(V)

wherein $R^{20}$ and $R^{21}$ are independently substituted or unsubstituted carboxymethyl (or equivalent salts) or 2-carboxyethyl (or equivalent salts), and $R^{22}$, $R^{23}$, $R^{24}$ and $R^{25}$ are independently hydrogen, a substituted or unsubstituted alkyl group of 1 to 5 carbon atoms (as defined above), hydroxy, carboxy, carboxymethylamino, or substituted or unsubstituted carboxymethyl (or equivalent salts), provided that only one of $R^{22}$, $R^{23}$, $R^{24}$ and $R^{25}$ is carboxy, carboxymethylamino, or substituted or unsubstituted carboxymethyl (or equivalent salts),

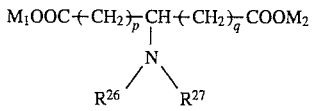

(VI)

wherein $R^{26}$ and $R^{27}$ are independently hydrogen, a substituted or unsubstituted alkyl group of 1 to 5 carbon atoms (as defined above), substituted or unsubstituted hydroxyethyl, substituted or unsubstituted carboxymethyl or 2-carboxyethyl (or equivalent salts), $M_1$ and $M_2$ are as defined above, and p and q are independently 0, 1 or 2 provided that the sum of p and q does not exceed 2, or

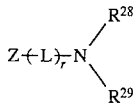

(VII)

wherein

Z represents a substituted or unsubstituted aryl group of 6 to 10 carbon atoms in the nucleus (as defined above) or a substituted or unsubstituted heterocycle having 5 to 7 carbon, nitrogen, sulfur and oxygen atoms in the nucleus (such as furanyl, thiofuranyl, pyrrolyl, pyrazolyl, triazolyl, dithiolyl, thiazolyl, oxazoyl, pyranyl, pyridyl, piperidinyl, pyrazinyl, triazinyl, oxazinyl, azepinyl, oxepinyl and thiapinyl), L is a divalent substituted or unsubstituted aliphatic linking group (defined below), $R^{28}$ and $R^{29}$ are independently hydrogen, a substituted or unsubstituted alkyl group of 1 to 5 carbon atoms (as defined above), a substituted or unsubstituted carboxyalkyl group of 2 to 4 carbon atoms (such as substituted or unsubstituted carboxymethyl or carboxyethyl or equivalent salts) or a hydroxy-substituted carboxyalkyl group of 2 to 4 carbon atoms (or equivalent salts), and r is 0 or 1.

The "divalent substituted or unsubstituted aliphatic linking group" in the definition of "W" and "L" noted above includes any nonaromatic linking group comprised of one or more alkylene, cycloalkylene, oxy, thio, amino or carbonyl groups which form a chain of from 1 to 6 atoms. Examples of such groups include, but are not limited to, alkylene, alkyleneoxyalkylene, alkylenecycloalkylene, alkylenethioalkylene, alkyleneaminoalkylene, alkylenecarbonyloxyalkylene, all of which can be substituted or unsubstituted, linear or branched, and others which would be readily apparent to one skilled in the art.

In defining the "substituted or unsubstituted" monovalent and divalent groups for the structures noted above, by "substituted" is meant the presence of one or more substituents on the group, such as an alkyl group of 1 to 5 carbon atoms (linear or branched), hydroxy, carboxy, sulfo, sulfonato, thioalkyl, alkylcarbonamido, alkylcarbamoyl, alkylsulfonamido, alkylsulfamoyl, carbonamido, sulfonamido, sulfamoyl, amino, halo (such as chloro or bromo), sulfono ($—SO_2R$) or sulfoxo [—S(O)R] wherein R is a branched or linear alkyl group of 1 to 5 carbon atoms.

In reference to the foregoing structures (I)–(VII), preferred definitions of groups are as follows:

$R^1$ and $R^2$ are independently hydrogen or hydroxy, $R^3$ and $R^4$ are independently hydroxy or carboxy, provided at least one hydroxy group is in compound (I), $R^6$, $R^7$, $R^8$, $R^9$ and $R^{10}$ are independently a substituted or unsubstituted alkylene group of 1 to 3 carbon atoms, $M_1$, $M_2$, $M_3$ and $M_4$ are independently hydrogen, ammonium, sodium or potassium, $R^{11}$, $R^{12}$, $R^{13}$, $R^{14}$, $R^{15}$ and $R^{16}$ are independently hydrogen, hydroxy or methyl, W is a covalent bond or a substituted or unsubstituted alkylene group of 1 to 3 carbon atoms, at least two of $R^{17}$, $R^{18}$ and $R^{19}$ are carboxymethyl and the third group is hydrogen, methyl, carboxymethyl or carboxyethyl, $R^{20}$ and $R^{21}$ are each carboxymethyl, $R^{22}$, $R^{23}$, $R^{24}$ and $R^{25}$ are independently hydrogen, carboxymethyl or carboxy, $R^{26}$ and $R^{27}$ are independently hydrogen, methyl or carboxymethyl, Z represents 2-pyridyl or 2-imidazolyl, L is substituted or unsubstituted alkylene of 1 to 3 carbon atoms, $R^{28}$ and $R^{29}$ are independently hydrogen, 2-carboxyethyl or carboxymethyl, and r is 1.

More preferred b) ligands are citric acid, tartaric acid, iminodiacetic acid, methyliminodiacetic acid, nitrilotriacetic acid, β-alaninediacetic acid, alaninediacetic acid, ethylenediaminedisuccinic acid, ethylenediaminediacetic acid, alaninedipropionic acid, isoserinediacetic acid, serinediacetic acid, iminodisuccinic acid, aspartic acid monoacetic acid, aspartic acid diacetic acid, aspartic acid dipropionic acid, 2-hydroxybenzyliminodiacetic acid and 2-pyridylmethyliminodiacetic acid. Certain biodegradable ligands (such as citric acid, nitrilotriacetic acid, β-alaninediacetic acid and ethylenediaminedisuccinic acid) in this list are most preferred.

Besides those ligands specifically defined in the foregoing description, there is considerable literature which describes additional useful ligands, such as EPA 0 567 126 (Seki et al), U.S. Pat. No. 5,250,401 (Okada et al) and U.S. Pat. No. 5,250,402 (Okada et al).

Many of these materials are commercially available or can be prepared by methods known to those skilled in the art.

A second class of carboxylate ligands is used to provide the ternary complex in the practice of this invention. Such compounds generally comprise at least one carboxyl group and an aromatic nitrogen hetrocycle. They are water-soluble and preferably biodegradable. Hereinafter, such ligands are identified as "c) ligands".

More specifically, c) ligands include substituted or unsubstituted 2-pyridinecarboxylic acids and substituted or unsubstituted 2,6-pyridinedicarboxylic acids (or equivalent salts). The substituents which may be on the pyridinyl ring include substituted or substituted alkyl, substituted or unsubstituted cycloalkyl or substituted or unsubstituted aryl groups (as defined above for structures I–VII), hydroxy, nitro, sulfo, amino, carboxy, sulfamoyl, sulfonamide, phospho, halo or any other group that does not interfere with ferric ion ternary complex formation, stability, solubility or catalytic activity. The substituents can also be the atoms necessary to form a 5- to 7-membered fused ring between any of the positions of the pyridinyl nucleus.

The preferred c) ligands of this type are represented by the following structures:

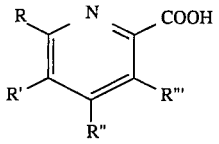

(VIII)

and

-continued

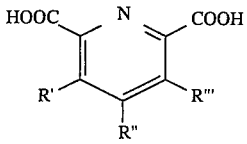

(IX)

wherein R, R', R'' and R''' are independently hydrogen, a substituted or unsubstituted alkyl group of 1 to 5 carbon atoms (as defined above), a substituted or unsubstituted aryl group of 6 to 10 carbon atoms (as defined above), a substituted or unsubstituted cycloalkyl group of 5 to 10 carbon atoms (as defined above), hydroxy, nitro, sulfo, amino, carboxy, sulfamoyl, sulfonamido, phospho or halo (such as chloro or bromo), or any two of R, R', R'' and R''' can comprise the carbon atoms necessary to form a substituted or unsubstituted 5 to 7-membered ring fused with the pyridinyl nucleus.

The monovalent and divalent radicals defining Structures VIII and IX can have substituents like those defining the radicals for Structures I–VII above.

Preferably, R, R', R'' and R''' are independently hydrogen, hydroxy or carboxy. The most preferred compounds are unsubstituted 2-pyridinecarboxylic acid and 2,6-pyridinedicarboxylic acid.

It should be understood that salts of these compounds are equally useful. Useful c) ligands are also described in various publications, including Japanese Kokai 51-07930 (noted above), EP-A-0 329 088 (noted above) and *J. Chem. Soc. Dalton Trans.*, 619 (1986).

The c) ligands can be obtained from a number of commercial sources or prepared using conventional procedures and starting materials (see for example, Syper et al, *Tetrahedron*, 36, 123–129, 1980 and Bradshaw et al, *J.Am. Chem. Soc.*, 102(2), 467–74, 1980).

The ternary complexes useful in this invention can be prepared and isolated as salts (such as ammonium or alkali metal salts), or they can be synthesized in situ as part of the preparation of the composition of this invention. Also, as noted above, the ferric complexes can be generated from the corresponding ferrous complexes which are then subjected to oxidation conditions. In the preparation of the complexes, the ligands and iron salt can be mixed together simultaneously or various components can be added in a suitable sequence. Preferably, the c) ligand is added to the reaction mixture after the iron salt and b) ligand.

As used herein, the terms "biodegradable" or "biodegradability" refer to at least 80% decomposition in the standard test protocol specified in by the Organization for Economic Cooperation and Development (OECD), Test Guideline 302B (Paris, 1981), also known as the "Modified Zahn-Wellens Test".

The concentration of ferric ion in the ternary complexes is generally at least 0.0005 mol/l. The specific amount for optimum effect will vary depending upon the specific ligands used and the specific use of the complex. The amount of ferric salt needed to obtain the desired amount of ferric ion in the complex would be readily apparent to one skilled in the art.

In the most general sense, the concentration of ferric ion is from about 0.0005 to about 1 mol/l, with from about 0.0005 to about 0.5 mol/l being preferred. The amount of ferric ion is more preferably from about 0.001 to about 0.2 mol/l, with most preferred amounts being from about 0.001 to about 0.05 mol/l.

The mol ratio of b) ligand to ferric ion in the ternary complex is at least 1:1, but the preferred amounts of b)

ligand can vary depending upon the specific ligand used and the use of the complex. More generally, the mol ratio is from 1:1 to 5:1, but preferred ratios are from 1:1 to 3.5:1. At mol ratios less than 1:1, rust formation and staining are more likely, and there is a greater tendency for the formation of water-insoluble salts.

The mol ratio of the c) ligand is at least 0.6:1. As with the other components of the complex, the optimum amount will vary depending upon the specific ligand used and the specific use of the complex. A more general mol ratio is from 0.6:1 to 4:1. As demonstrated in Example 7 below, at a mol ratio of less than 0.6:1, inferior bleaching or bleach/fixing results. At mol ratios significantly higher than 4:1, undesirable water-insoluble salts of ferric ion and c) ligand may form.

The amount of complex can be determined in a more functional manner by defining it as the amount needed to bleach at least 90% of the developed silver metal in a given imagewise exposed and developed silver halide color photographic element in a reasonable processing time, for example less than about 3 minutes. For some elements, such as photographic papers, this bleaching efficiency will be reached in much shorter times, whereas other elements, such as color negative films, will require longer times, for example up to 6.5 minutes. One skilled in the art could readily determine the appropriate amount of ternary complex to be used in the composition for a given type of photographic element with routine experimentation.

The pH value of the composition of the present invention helps establish formation of the ternary complex and aids in stability of peracid bleaching agents. The pH is preferably in the range of from about 2 to about 8, and most preferably in the range of from about 3 to about 7.

In order to adjust and control the pH, the composition includes one or more organic acidic compounds other than the compounds used to form the ternary complex. Such compounds are typically weak acids having a $pK_a$ between about 1.5 and about 7. Preferably, such acids are carboxylic acids having one or more carboxyl groups and a $pK_a$ of from about 2.5 to about 7. The amount of acid used is generally at least about 0.05 mol/l, and more preferably from about 0.1 to about 3 mol/l.

Useful acidic compounds include, but are not limited to, monobasic acids (such as acetic acid, propionic acid, glycolic acid, benzoic acid and sulfobenzoic acid), amino acids (such as asparagine, aspartic acid, glutamic acid, alanine, arginine, glycine, serine and leucine), dibasic acids (such as oxalic acid, malonic acid, succinic acid, glutaric acid, tartaric acid, fumaric acid, maleic acid, malic acid, oxaloacetic acid, phthalic acid, 4-sulfophthalic acid, 5-sulfoisophthalic acid and sulfosuccinic acid), tribasic acids (such as citric acid), and ammonium or alkali metal salts of any of the foregoing acids. Examples of preferred acids are acetic acid, glycolic acid, maleic acid, succinic acid, sulfosuccinic acid, 5-sulfoisophthalic acid and 4-sulfophthalic acid.

In this invention, the composition is a peracid bleaching composition which includes the ternary ferric complex as defined herein as a catalyst for the bleaching agent. Peracid bleaching agents can be divided into three classes: a) persulfates, b) peroxides (including percarbonates, perborates and perphosphates as peroxide precursors), and c) perhalogenates (including chlorates, bromates, iodates, perchlorates, perbromates and metaperiodates). Hydrogen, ammonium, alkali and alkaline earth salts of these compounds are also useful. Examples of bleaching compositions containing these agents are well known and described, for example, in *Research Disclosure,* publication 365, September 1994. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Especially preferred peracid bleaching compositions are the persulfate and peroxide bleaching compositions. Alkali metal or ammonium persulfate bleaching compositions are more preferred, and a sodium persulfate bleaching composition is most commonly used. The preferred peroxide bleaching composition is one containing hydrogen peroxide.

The amounts of bleaching agents used in peracid bleaching compositions are well known in the art. For example, in typical persulfate compositions, the amount of persulfate ion is generally from about 0.02 to about 1 mol/l. In typical peroxide compositions, the amount of peroxide is generally from about 0.1 to about 2 mol/l.

In a preferred embodiment of this invention, the bleaching composition of this invention comprises one or more rehalogenating agents, such as chloride, bromide or iodide. Chloride or bromide ion is preferably used as a rehalogenating agent. Chloride ion is particularly preferred when processing photographic elements in which 50% or more of the coated silver halide is silver chloride. In the presence of the ternary ferric complexes described herein, chloride ion is a highly effective rehalogenating agent without loss in strong bleaching capability. Generally, the amount of rehalogenating agent is from about 0.02 to about 2 mol/l with from about 0.05 to about 0.5 mol/l being preferred. The counterion used for the rehalogenating agent can be any acceptable cation such as ammonium, alkali metal or alkaline earth ions. Ammonium is preferred for bleaching efficiency and water solubility, but sodium and potassium may be more environmentally desirable.

The composition of this invention can also be what is known in the art as a silver-retentive bleaching composition and contain an organic silver salt instead of a halide rehalogenating agent, as described for example, in U.S. Pat. No. 4,454,224 (Brien et al).

As used herein in defining concentrations of reagents, the term "about" refers to ±20% of the indicated amount. In defining pH or $pK_a$ values, the term "about" refers to ±0.5 unit.

The composition of this invention can optionally contain one or more addenda commonly included in bleaching compositions, such as bleach accelerators, corrosion inhibitors, optical whitening agents, defoaming agents, calcium sequestrants and chlorine scavengers (see for example Research Disclosure, 175, page 42, No. 17556, 1978). The compositions can be formulated as a working bleaching solutions, solution concentrates or as dry powders or tablets.

A preferred embodiment of this invention comprises a composition for bleaching an imagewise exposed and developed silver halide photographic element comprising:

1) a peracid bleaching agent, 2) as a catalyst for the bleaching agent, a ternary complex formed from:

a) a ferric salt, b) citric acid or a salt thereof, and c) 2-pyridinecarboxylic acid or 2,6-pyridinecarboxylic acid, wherein the mol ratio of b) ligand to iron in the complex is from 1:1 to 3.5:1, and the mol ratio of c) ligand to iron in the complex is from 0.6:1 to 4:1, 3) acetic acid or glycolic acid buffer, and 4) one or more of the components selected from the group consisting of:

a rehalogenating agent, a defoaming agent, a chlorine scavenger, a bleach accelerator, a calcium sequestrant, a corrosion inhibitor, and an optical whitening agent.

The photographic elements to be processed using the present invention can contain any of the conventional silver halides as the photosensitive material, for example, silver chloride, silver bromide, silver bromoiodide, silver chlorobromide, silver chloroiodide, and mixtures thereof. Preferably, however, the photographic element is a high chloride element, containing at least 50 mole % silver chloride and more preferably at least 90 mole % silver chloride.

The photographic elements processed in the practice of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. The element can contain additional layers such as filter layers, interlayers, overcoat layers, subbing layers and the like as is well known in the art. The element may also contain a magnetic backing such as is also known in the art.

Considerably more details of photographic elements of many varieties are provided in the *"Research Disclosure"* publication noted above, which is incorporated herein by reference. Such details relate, for example, to useful silver halide emulsions (either negative-working or positive-working) and their preparation, color-forming couplers, color developing agents and solutions, brighteners, antifoggants, image dye stabilizers, hardeners, plasticizers, lubricants, matting agents, paper and film supports, and the various image-formation processes for both negative-image and positive-image forming color elements. Other suitable emulsions are (111) tabular silver chloride emulsions such as described in U.S. Pat. No. 5,176,991 (Jones et al), U.S. Pat. No. 5,176,992 (Maskasky et al), U.S. Pat. No. 5,178,997 (Maskasky), U.S. Pat. No. 5,178,998 (Maskasky et al), U.S. Pat. No. 5,183,732 (Maskasky), U.S. Pat. No. 5,185,239 (Maskasky), U.S. Pat. No. 5,292,632 (Maskasky), U.S. Pat. No. 5,314,798 (Brust) and U.S. Pat. No. 5,320,938 (House et al).

Photographic elements can be exposed to actinic radiation, typically in the visible region of the spectrum, to form a latent image using known methods and then processed to form a visible dye image. Processing includes the step of contacting the element with a color developing agent to reduce developable silver halide and to oxidize the color developing agent. Oxidized color developing agent in turn reacts with the coupler to yield a dye.

Photographic color developing compositions are employed in the form of aqueous alkaline working solutions having a pH of above 7 and most typically in the range of from about 9 to about 13.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching and fixing to remove silver and silver halide, washing and drying.

In some cases, a separate pH lowering solution, referred to as a stop bath, is employed to terminate development prior to bleaching. A stabilizer bath is commonly employed for final washing and hardening of the bleached and fixed photographic element prior to drying.

Conventional fixing solutions can be used in processing, such solutions containing one or more fixing agents, such as thiosulfates, thiocyanates, thioethers, amines, mercapto-containing compounds, thiones, thioureas, iodides and others which would be readily apparent to one skilled in the art. Particularly useful fixing agents include, but are not limited to, ammonium thiosulfate, sodium thiosulfate, potassium thiosulfate and guanidine thiosulfate, with ammonium thiosulfate being particularly preferred for rapid fixing. Useful and optimum amounts of fixing agents would be readily apparent to one skilled in the art, and are generally from about 0.1 to about 3.0 mol/l.

The fixing composition may also contain a preservative such as sulfite, for example, ammonium sulfite, a bisulfite, or a metabisulfite salt, or fixing accelerators.

Preferred processing sequences for color photographic elements, particularly color negative films and color print papers, include, but are not limited to, the following:

(P-1) Color development/Stop/Bleaching-fixing/Washing/Stabilizing/Drying.

(P-2) Color development/Stop/Bleaching-fixing/Stabilizing/Drying.

(P-3) Color development/Bleaching-fixing/Washing/Stabilizing/Drying.

(P-4) Color development/Bleaching-fixing/Washing.

(P-5) Color development/Bleaching-fixing/Stabilizing/Drying.

(P-6) Color development/Stop/Washing/Bleaching-fixing/Washing/Drying.

(P-7) Color development/Bleaching/Fixing/Stabilizing.

(P-8) Color development/Bleaching/Washing/Fixing/Washing/Stabilizing.

(P-9) Color development/Bleaching/Bleach-fixing/Fixing/Stabilizing.

In each of processes (P-1) to (P-9), variations are contemplated. For example, a bath can be employed prior to color development, such as a prehardening bath, or the washing step may follow the stabilizing step. Additionally, reversal processes which have the additional steps of black and white development, chemical fogging bath, light re-exposure, and washing before the color development are contemplated.

The following examples are intended to illustrate, but not limit, this invention.

EXAMPLE 1

Demonstration of Ternary Complex Formation

This example demonstrates that the composition of the present invention comprises a ternary complex formed from an iron salt and the b) and c) ligands defined herein.

The formation of ferric ion ternary complexes have been determined by redox potential measurements of solutions of ferrous ion, ferric ion and mixtures of the b) and c) ligands.

Four ligand solutions were prepared, each containing a ferric ion salt (2 mmol/l) and a ferrous ion salt (2 mmol/l). Solution 1 contained 2-pyridinecarboxylic acid (PCA) (50 mmol/l) as the only ligand. Solution 2 contained nitrilotriacetic acid (NTA) (5 mmol/l) as the only ligand. Solutions 3 and 4 contained 2-pyridinecarboxylic acid (50 mmol/l) and nitrilotriacetic acid (2 and 4 mmol/l, respectively).

Figure 2:
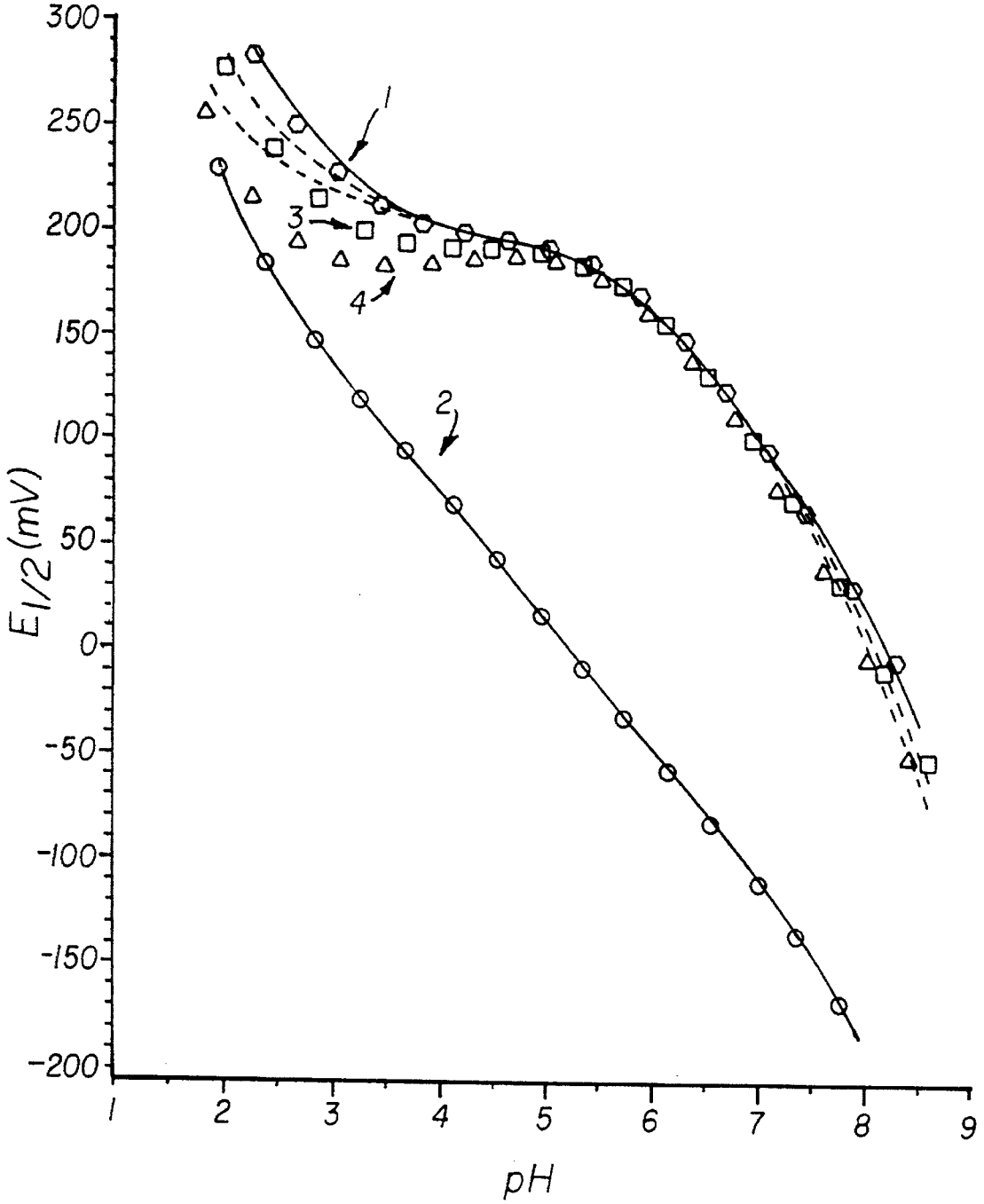

The resulting potentials ($E_{1/2}$ versus a saturated calomel electrode) of each solution were plotted as a function of solution pH, as shown in FIGS. 1 and 2. The numbered lines in the Figures correspond to the calculated potentials for each of the ligand solutions. It is evident that Solutions 3 and 4, containing both ligands, had more negative potentials than Solution 1, but not as negative as Solution 2. That a ternary complex was formed is evidenced by the fact that the solid lines in FIG. 1, which are calculated potentials based on formation of such as complex explain the measured potentials observed in Solutions 2 and 3. Without considering such a complex, the potentials for Solutions 2 and 3 cannot be explained, as shown by the dotted lines in FIG. 2. The potentials were calculated with the assumption that no ferric ion ternary complex has formed, but only separate binary complexes of each ligand with ferric ion, which is adequate to explain the potentials of Solutions 1 and 2.

Once the formation constant of the ternary complex was obtained by this analysis, the percentage of total ferric ion salt in the ternary complex was calculated for various concentrations of each ligand at different solution pH values. At pH 4, the optimum mol ratio of ligands and iron ion for this ligand combination, was a ratio of b) ligand:c) ligand-:iron of 1.2:1.3:1. The ternary complex comprised 83% of the total ferric ion in the solution under those conditions.

EXAMPLES 2–9

Various Bleaching Compositions

These examples demonstrate the preparation of several compositions of the present invention, as well as several comparative bleach compositions used in later examples.

For all compositions, the iron to ligand mol ratios were for iron:b) ligand:c) ligand.

A Control A composition was prepared by combining water (4 liters) with glacial acetic acid (480.4 g), citric acid (76.81 g) and sufficient 50% (w/w) aqueous sodium hydroxide to raise the pH to 4.2. Ferric nitrate nonahydrate (80.8 g) was added, along with sodium persulfate (238.1 g), sodium chloride (116.88 g) and water to dilute the solution to 7 liters. After the pH was adjusted to 4 with solid sodium carbonate, the solution was diluted with water to 8 liters. The iron to ligand ratio was 1:2:0.

A Control B composition was prepared similarly to the Control A composition except that equimolar 2-pyridinecarboxylic acid (49.24 g) was used in place of citric acid. A crystalline precipitate formed within few hours of preparing this solution. The iron to ligand was 1:0:2.

The Example 2 composition was prepared similarly to the Control A composition except that 2-pyridinecarboxylic acid (49.24 g) was added immediately after addition of the ferric nitrate nonahydrate. The iron to ligand ratio was 1:2:2.

A Control C composition was prepared by mixing water (50 ml), sodium chloride (1.46 g), acetate and ferric nitrate (5 ml of stock solution containing 2.5 mol/l acetic acid and 0.5 mol/l ferric nitrate nonahydrate, adjusted to pH 3.8 with sodium hydroxide and sodium carbonate), citric acid (5 ml of a stock solution containing 1 mol/l, adjusted to pH 3.6 with 50% aqueous sodium hydroxide) and sodium persulfate (25 ml of 1 mol/l stock solution). The resulting solution was adjusted to pH 4 with sodium carbonate and diluted with water to 100 ml. The iron to ligand ratio was 1:2:0.

Controls D, E and F were prepared similarly to Control C except that they additionally contained 0.25 ml (Control D), 0.5 ml (Control E) or 1 ml (Control F) of a solution (1 mol/l) of 2-pyridinecarboxylic acid which had been adjusted to pH 3.8 with sodium hydroxide. These solutions are representative of ligand to iron ratios described in Japanese Kokai 50-26542 (noted above). The iron to ligand ratios were 1:2:0.1, 1:2:0.2 and 1:2:0.4, respectively.

Examples 3–8 were prepared similarly to Control C except that they additionally contained 1.4 ml (Example 3), 2.5 ml (Example 4), 5 ml (Example 5), 10 ml (Example 6), 20 ml (Example 7) or 40 ml (Example 8) of a solution (1 mol/l) of 2-pyridinecarboxylic acid which had been adjusted to pH 3.8 with sodium hydroxide. The iron to ligand ratios were 1:2:0.6, 1:2:1, 1:2:2, 1:2:4, 1:2:8 and 1:2:16, respectively.

A Control G composition was prepared by mixing water (4 liters) with ethylenediaminetetraacetic acid (63.658 g), glacial acetic acid (48.04 g) and sufficient 50% (w/w) aqueous sodium hydroxide to raise the pH to 5. Ferric nitrate nonahydrate (80 g) and sodium chloride (120 g) were added, and the solution was diluted with water to 7 liters. Immediately before processing, hydrogen peroxide (800 ml of a 30% solution) was added, along with sufficient solid sodium carbonate to raise the pH to 5. The iron to ligand ratio was 1:1.1:0.

An Example 9 composition was prepared similarly to the Control G composition except that it additionally contained 2,6-pyridinedicarboxylic acid (36.402 g) which was added along with the other ligand. The iron to ligand ratio was 1:1.1:1.1.

EXAMPLE 10

Optimization of Bleaching Compositions

This example demonstrates the use of several compositions of this invention to bleach imagewise exposed and developed color photographic elements. It also compares the use of those compositions to the use of several control compositions for bleaching.

Samples (35 mm×304.8 mm each) of KODACOLOR GOLD ULTRA™ 400 speed color film were given a flash exposure on a conventional 1B sensitometer (1/100 second, 3000K, Daylight Va filter). The exposed samples were then developed and fixed (but not bleached) at 37.7° C. using conventional color negative processing solutions (see, for example *Brit.J. Photo.*, page 196, 1988) using the following protocol:

| | |
|---|---|
| 3 minutes, 15 seconds | Developer bath, |
| 1 minute | Stop bath, |
| 1 minute | Water wash, |
| 4 minutes | Fixing bath, |
| 3 minutes | Water wash, and |
| 1 minute | Water rinse. |

The film samples were then air dried. To measure a rate of bleaching, a 1.3 $cm^2$ round piece was removed from each sample and placed in a flow cell. This cell, 1 cm×1 cm×2 cm, was constructed to hold the round piece in an ultraviolet light/visible diode array spectrophotometer, enabling the visible absorption of the round piece to be measured while a processing solution was circulated over the face of the round piece. Both the processing solution (20 ml) and the flow cell were held at a constant temperature of 25° C. One hundred absorbance measurements (an average of the absorbances at 814, 816, 818, and 820 nm) were collected at 5-second intervals over a 500-second period of time. The absorbance as a function of time was plotted, and the time required for 90% bleaching was determined graphically. Control experiments indicated that this flow cell method is an excellent predictor of bleaching rates in a standard process run at 37.7° C.

The resulting bleaching rates at pH 4 for ferric-catalyzed persulate bleaching compositions using the noted bleaching protocol are provided in Table I below. The compositions contain a constant b) ligand:iron mol ratio of 2:1, and variable mol ratios of c) ligand to iron. Control compositions D, E and F are representative of bleaching compositions described in Japanese Kokai 50-26542 (noted above). It is apparent that the compositions of the present invention provided significant improvement in bleaching rate over the Control compositions.

TABLE I

| Composition | mol Ratio of Iron:b) Ligand:c) Ligand | Bleaching Rate |
|---|---|---|
| Control C | 1:2:0 | negligible after 500 seconds |
| Control D | 1:2:0.1 | negligible after 500 seconds |
| Control E | 1:2:0.2 | 12% bleaching after 500 seconds |
| Control F | 1:2:0.4 | 40% bleaching after 500 seconds |
| Example 3 | 1:2:0.6 | 70% bleaching after 500 seconds |
| Example 4 | 1:2:1 | 90% bleaching after 290 seconds |
| Example 5 | 1:2:2 | 90% bleaching after 89 seconds |
| Example 6 | 1:2:4 | 90% bleaching after 48 seconds |
| Example 7 | 1:2:8 | 90% bleaching after 55 seconds |
| Example 8 | 1:2:16 | 90% bleaching after 63 seconds |

EXAMPLE 11

Use of Invention As Ferric-Catalyzed Persulfate Bleaching Compositions

This example demonstrates the practice of this invention using the compositions of this invention as persulfate bleaching compositions and compares them to the use of similar conventional persulfate bleaching compositions.

Samples (35 mm×304.8 mm each) of KODACOLOR GOLD ULTRA™ 400 speed film were imagewise exposed using a conventional 1B sensitometer (1/100 second, 3000K, Daylight Va filter, 21 step 0–4 density chart). The exposed samples were processed at 37.7° C. using conventional color negative processing solutions (see Examples 2–9 above) using the following protocol:

| | |
|---|---|
| 3 minutes, 15 seconds | Developer bath, |
| 1 minute | Stop bath, |
| 1 minute | Water wash, |
| various times | Bleaching bath, |
| 3 minutes | Water wash, |
| 4 minutes | Fixing bath, |
| 3 minutes | Water wash, and |
| 1 minute | Water rinse. |

Bleach times of 0, 15, 30, 45, 60, 90, 120, 180 and 240 seconds were employed. The processed film samples were air dried, and the D-max residual silver (an average of values at steps 2, 3 and 4) was determined for each sample by conventional X-ray fluorescence spectroscopy. Data for residual silver as a function of time are provided in Table II below. The Control A composition, containing citrate as the only ligand, was completely inactive as a bleaching composition. The Control B composition, containing 2-pyridinecarboxylic acid as the only ligand, bleached silver extremely well, but caused rust stains in the film and produced a precipitate within hours of its preparation (as noted above in Examples 2–9).

Example 2 provided excellent bleaching, did not cause stain in the film and showed indefinite stability toward formation of precipitate.

TABLE II

| Bleaching Time | Residual Silver ($g/m^2$) | | |
|---|---|---|---|
| (Seconds) | Control A | Control B | Example 2 |
| 0 | 1.153 | 1.174 | 1.091 |
| 15 | 1.123 | 0.158 | 0.615 |
| 30 | 1.157 | 0.046 | 0.245 |
| 45 | 1.166 | 0.040 | 0.076 |
| 60 | 1.137 | 0.028 | 0.056 |
| 90 | 1.127 | 0.022 | 0.046 |
| 120 | 1.102 | 0.023 | 0.041 |
| 180 | 1.153 | 0.022 | 0.032 |
| 240 | 1.131 | 0.013 | 0.042 |

EXAMPLE 12

Catalyzed Peroxide Bleaching

This example demonstrates the practice of this invention using a ternary ferric complex to catalyze a peroxide bleaching agent.

Samples (35 mm×304.8 mm each) of KODACOLOR GOLD ULTRA™ 400 speed film were imagewise exposed using a conventional 1B sensitometer (1/100 sec, 3000K, Daylight Va filter, 21 step 0–4 density chart). The exposed samples were processed at 37.7° C. using conventional color negative processing solutions and the protocol described in Example 11 above.

The bleaching solutions identified above as Control G and Example 9 were used and compared. Bleaching times of 0, 15, 30, 45, 60, 90, 120, 180 and 240 seconds were used in the various experiments. The processed films were air dried, and the residual silver (an average of values at steps 2, 3 and 4) in the $D_{max}$ areas was determined for each sample by conventional X-ray fluorescence spectroscopy.

Although bleaching by both solutions was incomplete after 240 seconds, the residual silver data were used to graphically determine $t_{50}$ values (that is, the time for 50% of the 1.41 $g/m^2$ of silver to be bleached). The Control G solution bleached about 45.4% of the silver after 240 seconds, and an extrapolated $t_{50}$ was found to be 246 seconds. The solution of this invention had a $t_{50}$ of 144 seconds. These data illustrate that the bleaching rate was increased by including a ternary complex as catalyst according to the present invention.

The invention has been described in detail with particular reference to preferred embodiments thereof, but it will be understood that variations and modifications can be effected within the spirit and scope of the invention.

We claim:

1. A composition for bleaching an imagewise exposed and developed silver halide color photographic element comprising a peracid bleaching agent, and as a catalyst for said bleaching agent, a ternary complex comprising:

a) ferric ion present in an amount of from about 0.0005 to about 1 mol/l, b) a polycarboxylate or aminocarboxylate ligand, and c) a carboxylate ligand containing an aromatic nitrogen heterocycle, wherein the mol ratio of b) ligand to iron in said complex is at least 1:1, and the mol ratio of c) ligand to iron in said complex is at least 0.6:1, and said composition having a pH of from about 3 to about 7 provided by an acidic compound other than any of a), b) and c), said other acidic compound being present in an amount of at least about 0 05 mol/l, wherein, when said peracid bleaching agent is an ammonium or alkali metal persulfate bleaching agent, said bleaching agent is present in an amount of from about 0.02 to about 1 mol/l of persulfate ion, or when said peracid bleaching agent is a hydrogen peroxide or a percarbonate, perphosphate or perborate precursor thereof, said bleaching agent is present at from about 0.1 to about 2 mol/l of peroxide.

2. The composition of claim 1 wherein said iron salt is present in an amount of from about 0.001 to about 0.05 mol/l, the mol ratio of said b) ligand to iron in said complex is from 1:1 to 3.5:1, and said acidic compound providing the defined pH is a carboxylic acid buffer.

3. The composition of claim 1 wherein said iron salt is ferric nitrate nonahydrate, ferric persulfate, ferric oxide, ferric sulfate, ferric ammonium sulfate or ferric chloride and is present in an amount of from about 0.0005 to about 0.5 mol/l.

4. The composition of claim 1 wherein either or both of said b) ligand or c) ligand are biodegradable.

5. The composition of claim 1 wherein said b) ligand is a hydroxycarboxylic acid, an alkylenediaminetetracarboxylic acid having a tertiary nitrogen atom, an alkylenediaminetetraacetic acid having a secondary nitrogen atom, an iminopolyacetic acid, a substituted ethyliminopolycarboxylic acid, an aminopolycarboxylic acid having an aliphatic dibasic acid group or an amino ligand having an aromatic or heterocyclic substituent.

6. The composition of claim 5 wherein said b) ligand has one of the following structures:

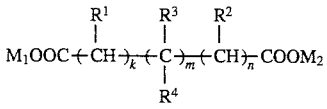

(I)

wherein $R^1$ and $R^2$ are independently hydrogen or hydroxy, $R^3$ and $R^4$ are independently hydrogen, hydroxy or carboxy, $M_1$ and $M_2$ are independently hydrogen or a monovalent cation, k, m and n are 0 or 1, provided that at least one of k, m and n is 1, and further provided that said compound (I) has at least one hydroxy group,

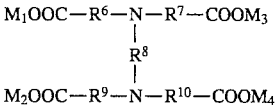

(II)

wherein $R^6$, $R^7$, $R^8$, $R^9$ and $R^{10}$ are independently an alkylene group of 1 to 6 carbon atoms, and $M_1$, $M_2$, $M_3$ and $M_4$ are independently hydrogen or a monovalent cation,

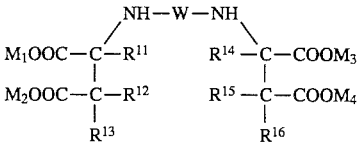

(III)

wherein $R^{11}$, $R^{12}$, $R^{13}$, $R^{14}$, $R^{15}$ and $R^{16}$ are independently hydrogen, hydroxy, an alkyl group of 1 to 5 carbon atoms, an cycloalkyl group of 5 to 10 carbon atoms, or an aryl group having 6 to 10 carbon atoms in the aromatic nucleus, $M_1$, $M_2$, $M_3$ and $M_4$ are as defined above, and W is a covalent bond or a divalent aliphatic linking group,

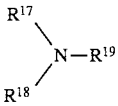

(IV)

wherein at least two of $R^{17}$, $R^{18}$ and $R^{19}$ are carboxymethyl, and the third group is hydrogen, an alkyl group of 1 to 5 carbon atoms, hydroxyethyl or carboxymethyl,

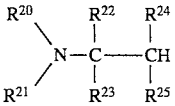

(V)

wherein $R^{20}$ and $R^{21}$ are independently carboxymethyl or 2-carboxyethyl, and $R^{22}$, $R^{23}$, $R^{24}$ and $R^{25}$ are independently hydrogen, an alkyl group of 1 to 5 carbon atoms, hydroxy, carboxymethylamino, carboxy or carboxymethyl, provided that only one of $R^{22}$, $R^{23}$, $R^{24}$ and $R^{25}$ is carboxy, carboxymethylamino or carboxymethyl,

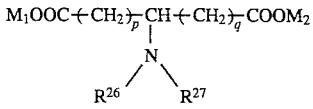

(VI)

wherein $R^{26}$ and $R^{27}$ are independently hydrogen, an alkyl group of 1 to 5 carbon atoms, hydroxyethyl, carboxymethyl or 2-carboxyethyl, $M_1$ and $M_2$ are as defined above, and p and q are independently 0, 1 or 2 provided that the sum of p and q does not exceed 2, or

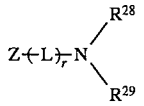

(VII)

wherein z represents an aryl of 6 to 10 carbon atoms in the nucleus or a heterocycle having 5 to 7 carbon, nitrogen, sulfur and oxygen atoms in the nucleus, L is a divalent aliphatic linking group, $R^{28}$ and $R^{29}$ are independently hydrogen, an alkyl group of 1 to 5 carbon atoms, a carboxyalkyl group of 2 to 4 carbon atoms or hydroxy-substituted carboxyalkyl of 2 to 4 carbon atoms, and r is 0 or 1.

7. The composition of claim 6 wherein said ligand b) is that having either structure I, III or IV.

8. The composition of claim 6 wherein said b) ligand is citric acid, tartaric acid, ethylenediaminetetraacetic acid, 1,3-propylenediaminetetraacetic acid, iminodiacetic acid, methyliminodiacetic acid, nitrilotriacetic acid, β-alaninediacetic acid, alaninediacetic acid, ethylenediamine disuccinic acid, ethylenediamine acetic acid, alaninedipropionic acid, isoserinediacetic acid, serinediacetic acid, iminodisuccinic acid, aspartic acid monoacetic acid, aspartic acid diacetic acid, aspartic acid dipropionic acid, 2-hydroxybenzyliminodiacetic acid or 2-pyridylmethyliminodiacetic acid.

9. The composition of claim 1 wherein said c) ligand has either the structure

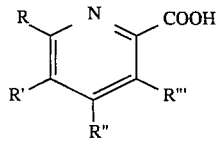

(VIII)

or

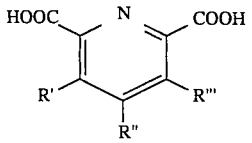

(IX)

wherein R, R', R" and R"' are independently hydrogen, an alkyl group of 1 to 5 carbon atoms, an aryl group of 6 to 10 carbon atoms, a cycloalkyl group of 5 to 10 carbon atoms, hydroxy, nitro, sulfo, amino, phospho, carboxy, sulfamoyl, sulfonamido or halo, or any two of R, R', R" and R"' can comprise the carbon atoms necessary to form a 5 to 7-membered ring fused with the pyridinyl nucleus.

10. The composition of claim 9 wherein said c) ligand is 2-pyridinecarboxylic acid, 2,6-pyridinedicarboxylic acid or a salt thereof.

11. The composition of claim 1 wherein said acidic compound is an organic acid having a $pK_a$ of from about 1.5 to about 6.5 and which is present in an amount of from about 0.05 to about 3 mol/l, providing the defined pH is a carboxylic acid buffer.

12. The composition of claim 1 wherein the mol ratio of said b) ligand to iron in said ternary complex is from 1:1 to 5:1, the mol ratio of said c) ligand in said ternary complex is from 0.6:1 to 4:1, and said acid compound has a $pK_a$ between about 1.5 and about 7 and is present in an amount of from about 0.1 to about 3 mol/l.

13. The composition of claim 1 further comprising a rehalogenating agent in an amount of from about 0.02 to about 2 mol/l.

14. A composition for bleaching or bleach/fixing an imagewise exposed and developed silver halide photographic element comprising:

1) a peracid bleaching agent, which is either a persulfate bleaching agent present in an amount of from about 0.02 to about 1 mol/l, or hydrogen peroxide or hydrogen peroxide precursor present in an amount of from about 0.1 to about 2 mol/l, 2) as a catalyst for said bleaching agent, a ternary complex comprising:

a) ferric ion present in an amount of from about 0.0005 to about 1 mol/l, b) citric acid or a salt thereof, and c) 2-pyridinecarboxylic acid or 2,6-pyridinecarboxylic acid, wherein the mol ratio of b) ligand to iron in said complex is from 1:1 to 3.5:1, and the mol ratio of c) ligand to iron in said complex is from 0.6:1 to 1:1, 3) acetic acid or glycolic acid buffer present in an amount of from about 0.1 to about 3 mol/l, and 4) one or more of the components selected from the group consisting of:

a rehalogenating agent,
a defoaming agent,
a chlorine scavenger,
a bleach accelerator,
a calcium sequestrant,
a corrosion inhibitor, and
an optical whitening agent.

15. A photographic bleaching method comprising processing an imagewise exposed and developed silver halide color photographic element with a bleaching composition comprising a peracid bleaching agent, and as a catalyst for said bleaching agent, a ternary complex comprising:

a) ferric ion present in an amount of from about 0.0005 to about 1 mol/l, b) a polycarboxylate or aminocarboxylate ligand, and c) a carboxylate ligand containing an aromatic nitrogen heterocycle, wherein the mol ratio of b) ligand to iron in said complex is at least 1:1, and the mol ratio of c) ligand to iron in said complex is at least 0.6:1, and said composition having a pH of from about 3 to about 7 provided by an acidic compound other than any of a), b) and c), said other acidic compound being present in an amount of least about 0.05 mol/l, wherein, when said peracid bleaching agent is an ammonium or alkali metal persulfate bleaching agent, said bleaching agent is present in an amount of from about 0.02 to about 1 mol/l of persulfate ion, or when said peracid bleaching agent is a hydrogen peroxide or a percarbonate, perphosphate or perborate precursor thereof, said bleaching agent is present at from about 0.1 to about 2 mol/l of peroxide.

16. The method of claim 15 wherein:

said iron salt is ferric nitrate nonahydrate, ferric sulfate, ferric oxide or ferric sulfate, and is present in said composition an amount of from about 0.0005 to about 0.5 mol/l, said b) ligand is a hydroxycarboxylic acid, an alkylenediaminetetracarboxylic acid having a tertiary nitrogen atom, an alkylenediaminetetraacetic acid having a secondary nitrogen atom, an iminopolyacetic acid, a substituted ethyliminopolycarboxylic acid, an aminopolycarboxylic acid having an aliphatic dibasic acid group or an amino ligand having an aromatic or heterocyclic substituent, said c) ligand is a substituted or unsubstituted 2-pyridinecarboxylic acid or a substituted or unsubstituted 2,6-pyridinedicarboxylic acid, and said acidic compound is an organic acid having a $pK_a$ of from about 1.5 to about 6.5 and is present in said composition in an amount of from about 0.05 to about 3 mol/l.

17. The method of claim 16 wherein said bleaching composition comprises a persulfate bleaching agent.

18. The method of claim 16 wherein said bleaching composition comprises a peroxide bleaching agent.

19. The method of claim 18 wherein said peroxide bleaching agent is hydrogen peroxide.

20. The method of claim 16 wherein:

said b) ligand has one of the following structures:

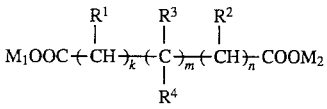

(I)

wherein $R^1$ and $R^2$ are independently hydrogen or hydroxy, $R^3$ and $R^4$ are independently hydrogen, hydroxy or carboxy, $M_1$ and $M_2$ are independently hydrogen or a monovalent cation, k, m and n are 0 or 1, provided that at least one of k, m and n is 1, and further provided that said compound (I) has at least one hydroxy group,

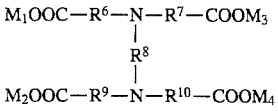

(II)

wherein $R^6$, $R^7$, $R^8$, $R^9$ and $R^{10}$ are independently alkylene of 1 to 6 carbon atoms, and $M_1$, $M_2$, $M_3$ and $M_4$ are independently hydrogen or a monovalent cation,

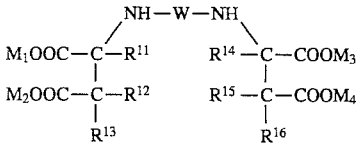

(III)

wherein $R_{11}$, $R^{12}$, $R^{13}$, $R^{14}$, $R^{15}$ and $R^{16}$ are independently hydrogen, hydroxy, an alkyl group of 1 to 5 carbon atoms, a cycloalkyl group of 5 to 10 carbon atoms, or an aryl group having 6 to 10 carbon atoms in the aromatic nucleus, $M_1$, $M_2$, $M_3$ and $M_4$ are as defined above, and W is a covalent bond or a divalent aliphatic linking group,

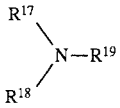

(IV)

wherein at least two of $R^{17}$, $R^{18}$ and $R^{19}$ are carboxymethyl, and the third group is hydrogen, an alkyl group of 1 to 5 carbon atoms, hydroxyethyl or carboxymethyl,

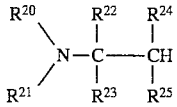

(V)

wherein $R^{20}$ and $R^{21}$ are independently carboxymethyl or 2-carboxyethyl, and $R^{22}$, $R^{23}$, $R^{24}$ and $R^{25}$ are independently hydrogen, an alkyl group of 1 to 5 carbon atoms, hydroxy, carboxy, carboxymethylamino or carboxymethyl, provided that only one of $R^{22}$, $R^{23}$, $R^{24}$ and $R^{25}$ is carboxy, carboxymethylamino or carboxymethyl,

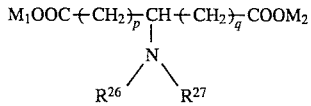

(VI)

wherein $R^{26}$ and $R^{27}$ are independently hydrogen, an alkyl group of 1 to 5 carbon atoms, hydroxyethyl, carboxymethyl or 2-carboxyethyl, $M_1$ and $M_2$ are as defined above, and p and q are independently 0, 1 or 2 provided that the sum of p and q does not exceed 2, or

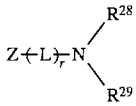

(VII)

wherein

Z represents an aryl of 6 to 10 carbon atoms in the nucleus or a heterocycle having 5 to 7 carbon, nitrogen, sulfur and oxygen atoms in the nucleus, L is a divalent aliphatic linking group, $R^{28}$ and $R^{29}$ are independently hydrogen, an alkyl group of 1 to 5 carbon atoms, a carboxyalkyl group of 2 to 4 carbon atoms or hydroxy-substituted carboxyalkyl of 2 to 4 carbon atoms, and r is 0 or 1, and said c) ligand has either the structure (VIII):

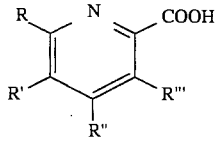

(VIII)

or

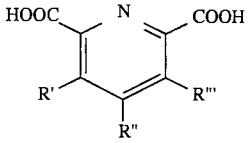

(IX)

wherein R, R', R" and R"' are independently hydrogen, an alkyl group of 1 to 5 carbon atoms, an aryl group or 6 to 10 carbon atoms, a cycloalkyl group of 5 to 10 carbon atoms, hydroxy, nitro, sulfonamido or halo, or any two of R, R', R" and R"' can comprise the carbon atoms necessary to form a 5- to 7-membered ring fused with the pyridinyl nucleus.

21. The method of claim 20 wherein said b) ligand is citric acid, tartaric acid, ethylenediaminetetraacetic acid, 1,3-propylenediaminetetraacetic acid, iminodiacetic acid, methyliminodiacetic acid, nitrilotriacetic acid, β-alaninediacetic acid, alaninediacetic acid, ethylenediamine disuccinic acid, ethylenediamine acetic acid, alaninedipropionic acid, isoserinediacetic acid, serinediacetic acid, iminodisuccinic acid, aspartic acid monoacetic acid, aspartic acid diacetic acid, aspartic acid dipropionic acid, 2-hydroxybenzyliminodiacetic acid or 2-pyridylmethyliminodiacetic acid.

* * * * *